United States Patent [19]

Ford, Jr. et al.

[11] 4,372,120

[45] Feb. 8, 1983

[54] V-TYPE ENGINE INTAKE WITH VIBRATION ISOLATED MANIFOLD CONNECTOR

[75] Inventors: Harry S. Ford, Jr., Birmingham; Nshan Hamparian, Brighton, both of Mich.

[73] Assignee: General Motors Corporation, Detroit, Mich.

[21] Appl. No.: 232,890

[22] Filed: Feb. 9, 1981

Related U.S. Application Data

[63] Continuation of Ser. No. 88,298, Oct. 26, 1979, abandoned.

[51] Int. Cl.[3] ..... F02B 37/00; F02B 75/22

[52] U.S. Cl. ..... 60/605; 123/52 MV; 123/52 M; 277/180

[58] Field of Search ..... 60/605; 123/52 M, 52 MV, 123/559; 277/180, 235 B

[56] References Cited

U.S. PATENT DOCUMENTS

| | | | |
|---|---|---|---|
| 2,305,295 | 12/1942 | Lang et al. | 60/605 |
| 2,362,493 | 11/1944 | Lowther | 123/559 |
| 2,722,203 | 11/1955 | Drinkard et al. | 123/52 MV |
| 3,520,284 | 7/1970 | Ruoff et al. | 123/52 MV |
| 3,673,798 | 7/1972 | Kuehl | 60/605 |
| 3,863,936 | 2/1975 | Farnam et al. | 277/235 B X |
| 4,054,108 | 10/1977 | Gill | 123/52 MV X |
| 4,118,041 | 10/1978 | Futamura | 277/166 X |
| 4,122,820 | 10/1978 | Ryberg | 123/52 MV X |

FOREIGN PATENT DOCUMENTS

| | | | |
|---|---|---|---|
| 519513 | 3/1940 | United Kingdom | 123/559 |

*Primary Examiner*—Michael Koczo
*Attorney, Agent, or Firm*—Robert J. Outland

[57] ABSTRACT

The noise level of a V-type diesel engine is reduced by providing a multi-piece intake manifold system including a pair of separate intake manifolds mounted on the inside valley defining walls of the engine cylinder banks and joined by an air supplying manifold connector mounted on both manifolds with isolation mounting means that limit the transmission of noise creating vibrations to the connector and between the manifolds and their respective cylinder banks.

5 Claims, 4 Drawing Figures

V-TYPE ENGINE INTAKE WITH VIBRATION ISOLATED MANIFOLD CONNECTOR

This is a Continuation of application Ser. No. 88,298, filed Oct. 26, 1979, now abandoned.

TECHNICAL FIELD

This invention relates to internal combustion engines having V-arranged cylinder banks and more particularly to sound reducing isolated manifold means for such engines.

BACKGROUND OF THE INVENTION

It is commonly known in the art relating to V-type internal combustion engines to provide a onepiece intake manifold mounted in the valley between the banks on the inside walls or the tops of the cylinder heads. Such an arrangement ties the two cylinder banks together at their upper ends and usually provides a simple and clean appearing structure through which air is delivered from an intake filter, turbocharger, carburetor, or other air or air fuel mixture handling device. In another known arrangement for a diesel engine, separate manifold chambers integrated with a camshaft gallery cover are connected by a separate distribution fitting or connector that supplies air to the separate chambers for both banks. Other arrangements are also known.

SUMMARY OF THE INVENTION

It has been found, in conjunction with development of a new diesel engine design, that a single integrated manifold connected between the banks of a V-type diesel engine may transmit noise creating vibrations to the manifold and between the cylinder banks which result in the transmission of noise from the engine.

The present invention substantially reduces the transmitted noise level from an engine of this type by providing an induction system which has two separate manifolds, one for each cylinder bank, mounted on the inside walls of their respective cylinder heads in the valley between the banks. Air is supplied to both manifolds by a manifold connector which is mounted on the manifolds by means of isolation mounting devices. These include resilient gaskets and isolated controlled compression securing means, which limit the transmission of noise creating vibrations to the connector or between the manifolds and cylinder banks. Stop plates and shoulder bolts having resilient sleeve and washer isolation devices are used in the arrangement with aluminum manifold and connector components to provide a low weight assembly.

The arrangement is applicable to both naturally aspirated and turbocharged versions of the engine through utilizing different forms of connector devices and associated equipment.

These and other features and advantages of the invention will be more fully understood from the following description of certain preferred embodiments taken together with the accompanying drawings.

BRIEF DESCRIPTION OF THE DRAWINGS

Figure 1:
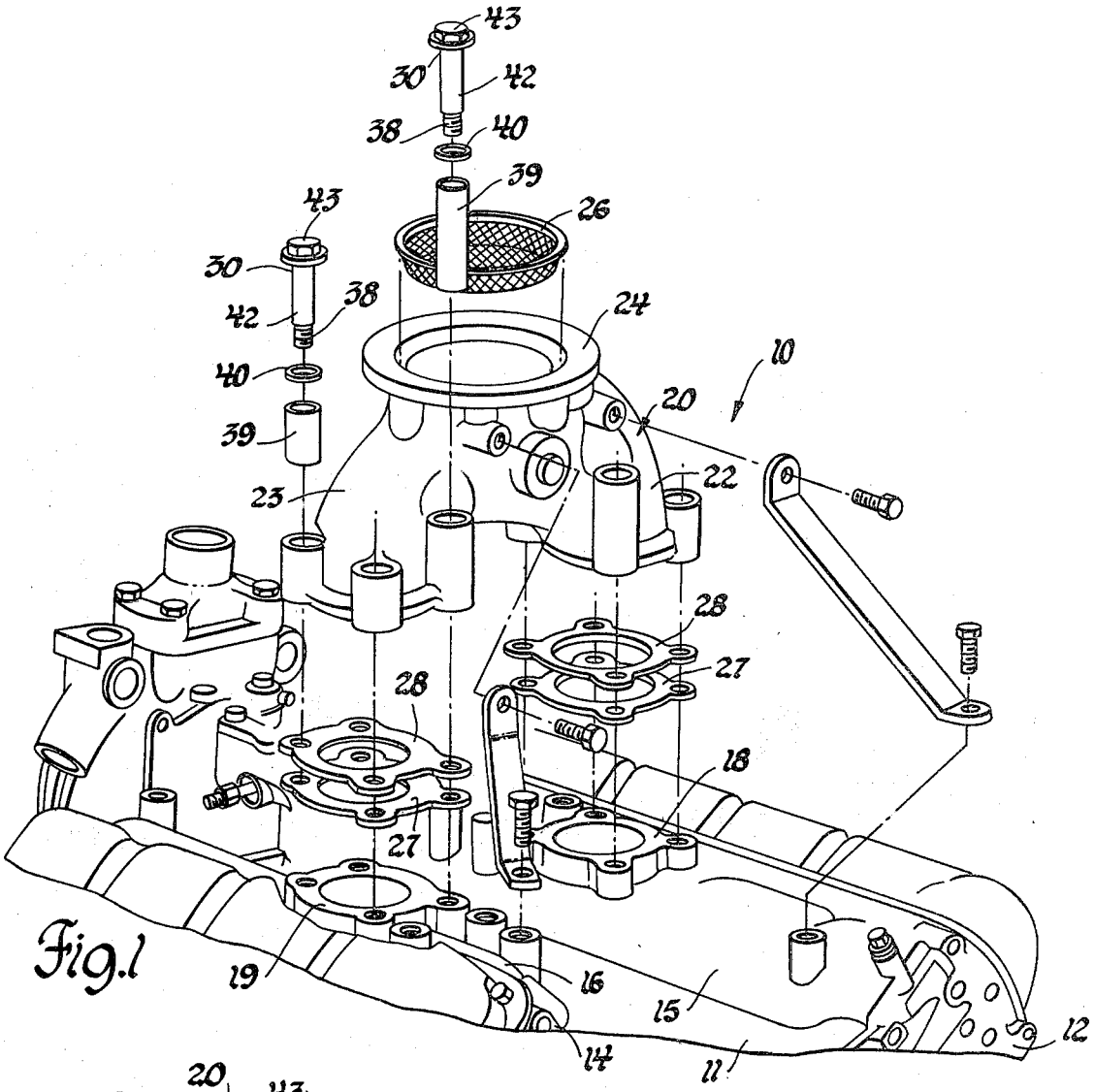
Figure 2:
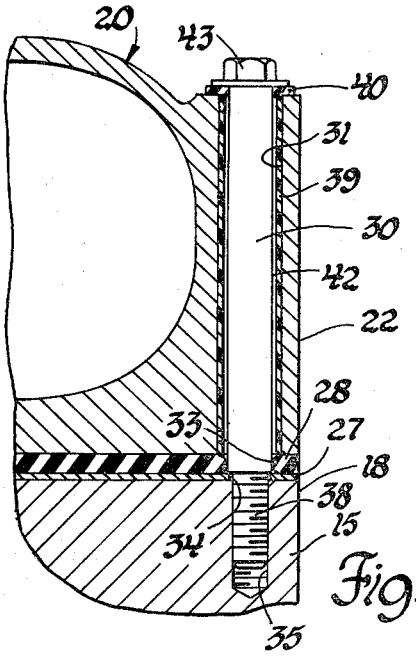
Figure 3:
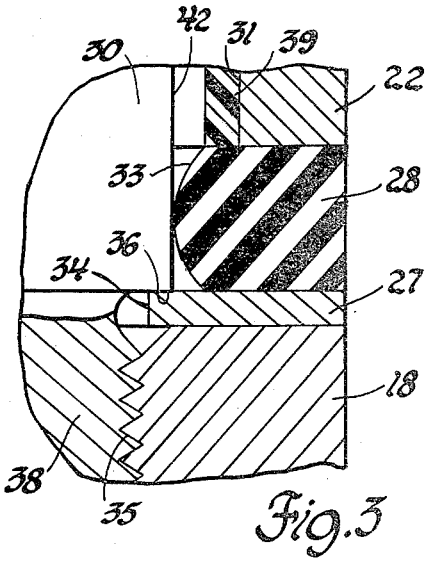
Figure 4:
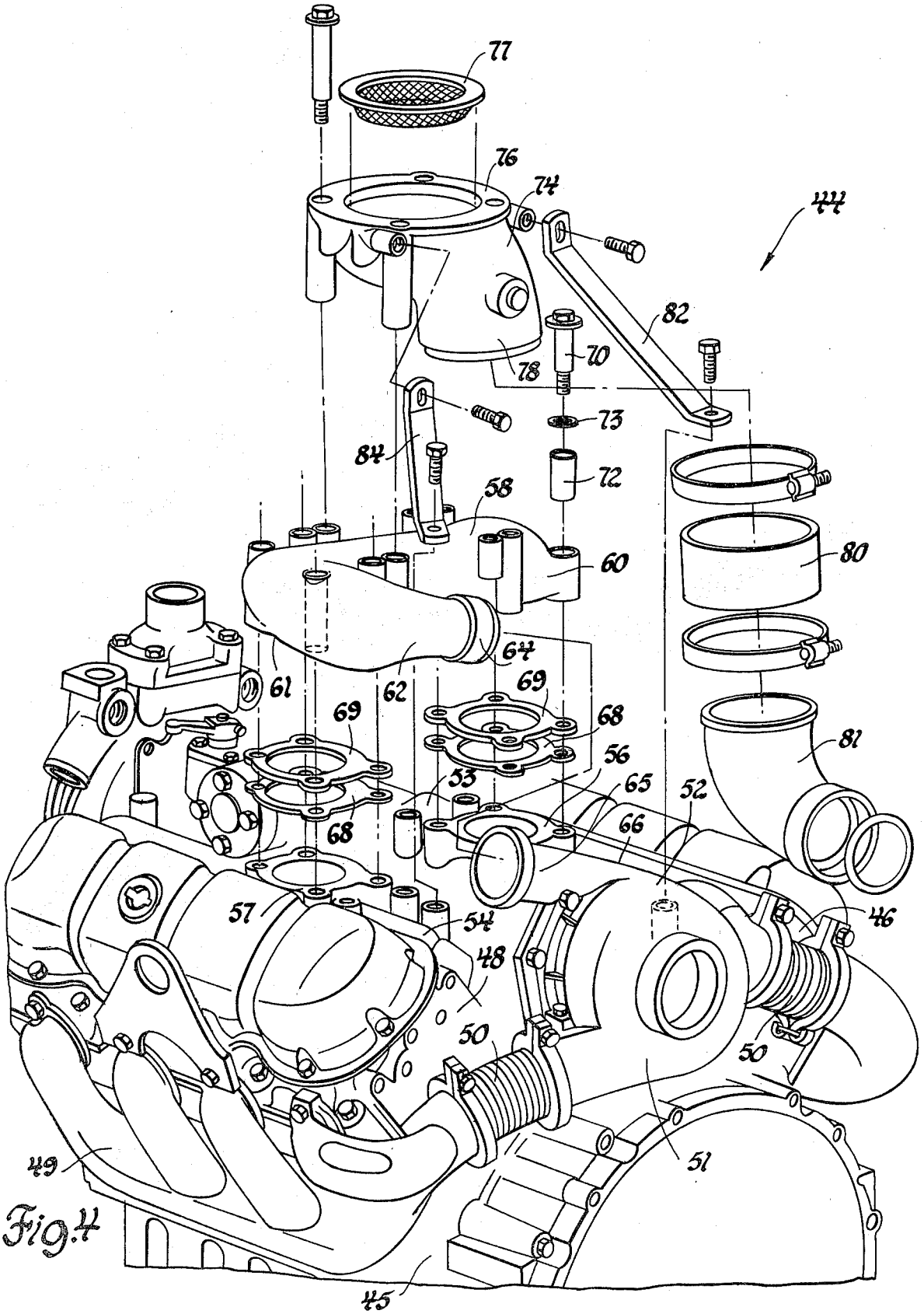

IN THE DRAWINGS:

FIG. 1 is a fragmentary pictorial view showing the upper portions of a V-type diesel internal combustion engine having an intake system with isolated connector means in accordance with the invention;

FIG. 2 is a fragmentary cross-sectional view through a portion of the connector and manifold showing one of the isolation gaskets and securing means;

FIG. 3 is an enlarged view of a portion of FIG. 2 showing more fully certain details of the construction, and FIG. 4 is a pictorial view of the upper portion of a turbocharged V-type diesel internal combustion engine having isolated manifold and connector means in accordance with the invention.

BEST MODES FOR CARRYING OUT THE INVENTION

Referring now to the drawings in detail, numeral 10 generally indicates a V-type diesel internal combustion engine having a cylinder block 11 with two cylinder banks on which are respectively mounted a pair of cylinder heads 12 and 14. The cylinder heads conventionally include air intake ports, not shown, which are supplied with intake air by a pair of separate intake manifolds 15, 16, preferably made of aluminum for low weight. The manifolds are mounted in the valley between the cylinder banks on the inner walls of their respective cylinder heads 12, 14, being solidly secured to the cylinder heads by conventional means.

The manifolds 15, 16 respectively, include upwardly opening inlet flanges 18, 19 spaced laterally opposite one another in the valley between the banks and through which air is supplied to their respective manifolds and cylinder banks. On these flanges there is carried a manifold connector 20 which includes a pair of downwardly opening flanged legs 22, 23 extending to a central upwardly opening entry portion 24. This portion is preferably fitted with an inlet screen 26 and is adapted to mount an air cleaner or other air supply device, not shown. In order to limit the weight of the combination, the manifolds and connector are preferably formed from a light metal such as aluminum.

The manifold connector 20 is mounted on the intake manifolds 15, 16 by isolation mounting means. These include relatively thin steel stop plates 27 seated on the manifold inlet flanges 18, 19 and relatively thick resilient seals, preferably in the form of silicone rubber gaskets 28, carried above the stop plates and beneath the flanged legs 22, 23 of the connector. The inner diameters of the gaskets 28 extend slightly inwardly of the inner diameters of the stop plates in order to provide for sealing of the air passages upon compression of the gaskets.

The gaskets are compressed and the connector is retained in place on the manifold inlet flanges by isolated controlled compression securing means. These comprise a plurality of variously sized shoulder bolts 30 which extend through bolt openings 31, 33 and 34 of the manifold connector, the sealing gaskets, and the stop plates respectively and are secured in threaded openings 35 provided in the inlet flanged portion of the two manifolds. Each of the bolts 30 includes a stop shoulder 36 which is of slightly larger diameter than the threaded portion 38 received in the openings 35 and of larger diameter than the openings 34 in the stop plates so as to engage and seat against the upper surfaces of the stop plates adjacent the openings 34, thus providing controlled compression of the sealing gaskets 28 when the bolts are secured. The stop plates are needed only to provide a harder surface than that of the aluminum manifold material for engagement by the bolt shoulders.

Isolation of the bolts from the connector member is provided by elastic sleeves 39 and washers 40 which are disposed respectively within the bolt openings 31 of the connector surrounding body portions 42 of the bolts and between the bolt heads 43 and the opposed portions of the connector. The material of the elastic sleeves and washers is of relatively firm elastic construction compared to the relatively soft silicone rubber material of the sealing gaskets so that the compression applied by the bolts is taken up substantially by controlled compression of the gaskets short of their point of full compression.

In operation, the described arrangement of individual manifolds with separate connector and isolation mounting means effectively limits the transmission of noise creating vibrations from the two cylinder banks through the manifolds to the connector or to the opposite cylinder banks and manifolds. This provides a reduced level of noise transmission from the engine as compared with the application of a solid integrated manifold arrangement.

Referring now to FIG. 4 of the drawings, there is disclosed an alternative embodiment of the invention as applied to a turbocharged V-type diesel internal combustion engine generally indicated by numeral 44. Engine 44 includes the usual cylinder block 45 defining a pair of cylinder banks on which are mounted cylinder heads 46, 48. On their outer sides the cylinder heads mount exhaust manifolds 49, which are connected by expansion couplers 50 with the turbine housing 51 of a turbocharger 52 mounted on one end of the engine.

On their inner sides, the cylinder heads 46, 48 mount, within the valley formed by the cylinder banks, a pair of intake manifolds 53, 54. These manifolds are respectively provided with inlet flanges 56, 57 which are laterally spaced on opposite sides of the valley and carry a manifold connector 58. Connector 58 comprises an elongated body having a pair of outlet portions 60, 61 to which air is supplied from a tubular inlet portion 62 connected by a hose 64 with the air outlet 65 of the turbocharger compressor 66.

As with the previous embodiment, the manifold connector 58 is mounted on the intake manifolds 53, 54 by isolation mounting means including stop plates 68 and sealing gaskets 69, preferably of silicone rubber. The connector is secured and the gaskets are compressed a predetermined amount by isolated controlled compression securing means, including shoulder bolts 70 and resilient sleeves 72 and washers 73 which are received in openings of the connector gaskets, stop plates and manifolds in similar fashion to the corresponding elements of the first described embodiment. These elements thus operate in similar fashion to limit the transmission of noise creating vibrations from the engine cylinder banks to the connector and to the opposite manifolds and cylinder banks.

An air inlet fitting 74 having an inlet portion 76 containing a screen 77 and adapted to receive an air intake filter or other air delivery device, not shown, is securely mounted on top the manifold connector 58. The inlet fitting has an outlet portion 78 that is connected by a hose 80 with a conduit elbow 81 which in turn connects with the inlet, not shown, of the turbocharger compressor 66. Various angled retaining straps 82, 84 are provided to prevent excessive rocking motion of the resiliently mounted manifold connector and inlet fitting assembly on the manifolds.

In operation, the isolation mounting and securing means for the manifold connector operate as in the previously described embodiment to limit the transmission of vibrations to the connector and between manifolds. In addition, transmission of vibrations from the engine block and turbocharger to the inlet fitting and manifold connector assembly is limited by use of the resilient hose connections from the turbocharger compressor respectively. Thus the transmission of noise creating vibrations between the cylinder banks and components of the engine induction system is limited and the resultant transmission of noise from the engine is reduced.

While the invention has been described by reference to certain preferred embodiments, it should be understood that various changes could be made within the spirit and scope of the inventive concepts described. Accordingly, it is intended that the invention not be limited except in accordance with the language of the following claims.

The embodiments of the invention in which an exclusive property or privilege is claimed are defined as follows:

1. In combination in a V-type engine having a pair of angularly disposed cylinder banks extending from a common crankcase and defining an intermediate valley, a pair of air intake manifolds secured one to each of said cylinder banks and spaced laterally from one another on opposite sides of the valley to deliver air charges to the engine cylinders, a manifold connector mounted upon and connecting with both said intake manifolds to carry charging air from a common supply to the manifolds, and isolation mounting means between said connector and said manifolds to limit the transmission of noise creating vibrations between the manifolds and cylinder banks and to the manifold connector, said isolation mounting means including resilient gaskets operatively disposed between each of said manifolds and said connector to seal the joints therebetween and isolated controlled compression securing means operatively connected between said connector and each associated manifold member and resiliently isolated from at least one of them, while retaining said connector on said manifolds with predetermined partial compression of said gaskets so as to provide complete resilient isolation of the connector from both the manifolds on which it is mounted.

2. The combination of claim 1 wherein said controlled compression securing means comprise shoulder bolts secured to said manifolds and having stop shoulders operatively engaging their respective manifolds to limit compression of said gaskets, said isolation mounting means further including means between said bolts and the opposing portions of said connector to limit the transmission of noise creating vibrations to the connector through said bolts.

3. A combination as defined in either of claims 1 or 2 and further including a turbocharger mounted on said engine and including a compressor having an inlet and an outlet, wherein said connector is connected with said compressor outlet and supports an inlet fitting that is connected with said compressor inlet, and resilient connecting means in the connections between said compressor and said connector and inlet fitting to limit the transmission of noise creating vibrations therebetween.

4. In combination in a V-type engine having a pair of angularly disposed cylinder banks extending from a common crankcase and defining an intermediate valley, a pair of air intake manifolds secured one to each of said cylinder banks and spaced laterally from one another on opposite sides of the valley to deliver air charges to the engine cylinders, a manifold connector mounted upon and connecting with both said intake manifolds to carry charging air from a common supply to the manifolds and the associated cylinder banks, and isolation mounting means operatively effective between said connector and said cylinder banks to limit the transmission of noise creating vibrations between the cylinder banks and to the manifold connector, said isolation mounting means including resilient gaskets operatively disposed between each of said cylinder banks and said connector to seal joints therebetween and isolated controlled compression securing means operatively connected between said connector and each associated cylinder bank and resiliently isolated from at least one of them, while retaining said connector on said cylinder banks with predetermined partial compression of said gaskets so as to provide complete resilient isolation of the connector from both the cylinder banks on which it is operatively mounted.

5. In combination in a V-type engine having a pair of angularly disposed cylinder banks extending from a common crankcase and defining an intermediate valley, intake manifold means operatively secured to and connecting with both said cylinder banks to carry charging air from a common supply to cylinders in said cylinder banks, and isolation mounting means operatively connected between said manifold means and said cylinder banks to limit the transmission of noise creating vibrations between the cylinder banks and to the manifold means, said isolation mounting means including resilient vibration isolating gaskets operatively disposed between each of said cylinder banks and said manifold means to seal joints therebetween and isolated controlled compression securing means operatively connected between said manifold means and each associated cylinder bank and resiliently isolated from at least one of them, while operatively retaining said manifold means on said cylinder banks with predetermined partial compression of said gaskets so as to provide complete resilient isolation of the manifold means from both the cylinder banks on which it is operatively mounted.

* * * * *